US011319619B2

(12) United States Patent
Kim et al.

(10) Patent No.: US 11,319,619 B2
(45) Date of Patent: May 3, 2022

(54) NON-ORIENTED ELECTRICAL STEEL SHEET AND MANUFACTURING METHOD THEREFOR

(71) Applicant: POSCO, Pohang-si (KR)

(72) Inventors: Jae-Hoon Kim, Pohang-si (KR); Jong Uk Ryu, Pohang-si (KR); Hun Ju Lee, Pohang-si (KR); Yoon Sung Kim, Pohang-si (KR)

(73) Assignee: POSCO, Pohang-si (KR)

( * ) Notice: Subject to any disclaimer, the term of this patent is extended or adjusted under 35 U.S.C. 154(b) by 244 days.

(21) Appl. No.: 16/470,929

(22) PCT Filed: Dec. 19, 2017

(86) PCT No.: PCT/KR2017/015022

§ 371 (c)(1),
(2) Date: Jun. 18, 2019

(87) PCT Pub. No.: WO2018/117597

PCT Pub. Date: Jun. 28, 2018

(65) Prior Publication Data

US 2020/0095659 A1 Mar. 26, 2020

(30) Foreign Application Priority Data

Dec. 19, 2016 (KR) ..... 10-2016-0173567

(51) Int. Cl.

| | |
|---|---|
| ***C22C 38/06*** | (2006.01) |
| ***C22C 38/02*** | (2006.01) |
| ***C22C 38/04*** | (2006.01) |
| ***C21D 8/12*** | (2006.01) |
| ***H01F 1/16*** | (2006.01) |

(52) U.S. Cl.

CPC ..... *C22C 38/06* (2013.01); *C21D 8/1222* (2013.01); *C21D 8/1261* (2013.01); *C22C 38/02* (2013.01); *C22C 38/04* (2013.01); *H01F 1/16* (2013.01)

(58) Field of Classification Search

None

See application file for complete search history.

(56) References Cited

U.S. PATENT DOCUMENTS

| | | | | |
|---|---|---|---|---|
| 2013/0224064 | A1 | 8/2013 | Zhang et al. | |
| 2019/0189318 | A1* | 6/2019 | Uesaka | H01F 1/16 |
| 2019/0271053 | A1* | 9/2019 | Georgeou | C22C 38/004 |
| 2021/0062284 | A1* | 3/2021 | Kim | C21D 6/008 |

FOREIGN PATENT DOCUMENTS

| | | | |
|---|---|---|---|
| CN | 1720344 | A | 1/2006 |
| CN | 101343683 | A | 1/2009 |
| CN | 101603145 | A | 12/2009 |
| CN | 102906289 | A | 1/2013 |
| CN | 105908073 | A | 8/2016 |
| EP | 3165624 | A1 | 5/2017 |
| JP | H08-333658 | A | 12/1996 |
| JP | H10-310850 | A | 11/1998 |
| JP | 2001-279396 | A | 10/2001 |
| JP | 2001-335897 | A | 12/2001 |
| JP | 2002-302746 | A | 10/2002 |
| JP | 2004-084053 | A | 3/2004 |
| JP | 2004-218082 | A | 8/2004 |
| JP | 2005-264315 | A | 9/2005 |
| JP | 2005-336503 | A | 12/2005 |
| JP | 2007-031755 | A | 2/2007 |
| JP | 2007-031793 | A | 2/2007 |
| JP | 2010-018857 | A | 1/2010 |
| JP | 2011-006721 | A | 1/2011 |
| JP | 2011-089204 | A | 5/2011 |
| JP | 4779474 | B2 | 9/2011 |
| JP | 2011-246810 | A | 12/2011 |
| JP | 2012-036459 | A | 2/2012 |
| JP | 2016156044 | A | 9/2016 |
| KR | 10-0418208 | B1 | 2/2004 |
| KR | 10-0479992 | B1 | 3/2005 |
| KR | 10-0544584 | B1 | 1/2006 |
| KR | 10-0544612 | B1 | 1/2006 |
| KR | 10-0544417 | B1 | 4/2006 |
| KR | 10-0733345 | B1 | 6/2007 |
| KR | 10-0832342 | B1 | 5/2008 |
| KR | 10-1037159 | B1 | 5/2011 |
| KR | 10-1051747 | B1 | 7/2011 |
| KR | 10-1059215 | B1 | 8/2011 |
| KR | 10-1067478 | B1 | 9/2011 |
| KR | 10-1089305 | B1 | 12/2011 |
| KR | 10-1141278 | B1 | 5/2012 |
| KR | 10-2013-0125830 | A | 11/2013 |
| KR | 10-2014-0044929 | A | 4/2014 |
| WO | 2016/002904 | A1 | 1/2016 |

OTHER PUBLICATIONS

Machine translation of JP 2016-156044A. Sep. 1, 2016. (Year: 2016).*

Machine translation of JPH10-310850A. (Year: 1998).*

Japanese Office Action dated Jul. 21, 2020 issued in Japanese Patent Application No. 2019-532753.

Chinese Office Action dated Aug. 12, 2020 issued in Chinese Patent Application No. 201780078457.6.

International Search Report and Written Opinion dated Apr. 3, 2018 issued in International Patent Application No. PCT/KR2017/015022 (with partial English translation).

European Office Action dated Jan. 15, 2021 issued in European Patent Application No. 17882908.1.

Extended European Search Report dated Oct. 17, 2019 issued in European Patent Application No. 17882908.1.

Chinese Notice of Allowance dated Jun. 29, 2021 issued in Chinese Patent Application No. 201780078457.6.

Indian Office Action dated Nov. 16, 2021 issued in Indian Patent Application No. 201947026408 (with English translation).

* cited by examiner

*Primary Examiner* — Xiaowei Su

(74) *Attorney, Agent, or Firm* — Morgan, Lewis & Bockius LLP

(57) ABSTRACT

A non-oriented electrical steel sheet according to an embodiment of the present invention comprises Si: 2.0 to 3.5%, Al: 0.3 to 3.5%, Mn: 0.2 to 4.5%, Zn: 0.0005 to 0.02% in wt % and Fe and inevitable impurities as a balance amount.

13 Claims, No Drawings

NON-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015022, filed on Dec. 19, 2017, which in turn claims the benefit of Korean Application No. 10-2016-0173567, filed on Dec. 19, 2016, the entire disclosures of which applications are incorporated by reference herein.

TECHNICAL FIELD

The present invention relates to a non-oriented electrical steel sheet and a manufacturing method thereof.

INVENTION TECHNICAL BACKGROUND

Effective use of electric energy has become a big issue for improving the global environment such as energy saving, reduction of fine dust generation and reduction of greenhouse gas and the like.

Since more than 50% of the total electric energy that is currently being generated is consumed in the electric motor, high efficiency of the electric motor is indispensable to achieve high efficient use of electricity.

In recent years, as the field of eco-friendly vehicle (Hybrid, plug-in hybrid, electric vehicle and fuel cell vehicle) has been rapidly developed, interest in high-efficiency drive motor is rapidly increasing, and high efficiency such as high efficiency motors for home appliances and super premium motors for heavy electric appliances have been recognized and government regulations are continuing, so demand for efficient use of electric energy is higher than ever.

On the other hand, in order to achieve high efficiency of the electric motor, an optimization is very important in all areas from selection of materials to design, assembly and control Especially, in the material point of view, the magnetic characteristics of the electrical steel sheet are the most important, so that there is a high demand for low iron loss and high magnetic flux density.

The properties of high-frequency low iron loss are very important for dive motor of automobiles or air conditioning compressors that must be driven not only in the power frequency range but also in the high frequency range.

In order to obtain such high-frequency low iron loss properties, a large amount of specific resistance elements such as Si, Al, and Mn must be added in the manufacturing process of the steel sheet, and the inclusions and fine precipitates present inside the steel sheet must be actively controlled to prevent them from interfering with the domain wall movement.

However, in order to purify the impurity elements such as C, S, N, Ti, Nb, V and the like in the steel manufacturing to an extremely low level for controlling inclusions and fine precipitates, it is necessary to use high quality raw materials, and there is a problem that the productivity is dropped since the secondary refining takes a long time.

Therefore, although the research for controlling an extremely low level of an impurity elements and a method for adding a large amount of a specific resistance element such as Si, Al, and Mn have been doing, the substantial application results in this regard are insignificant.

CONTENTS OF THE INVENTION

Problem to Solve

An embodiment of the present invention is to provide a non-oriented electrical steel sheet improved in magnetic property by minimizing fine impurities such as inclusions, precipitates and the like by facilitating the domain wall movement without strengthening secondary refining in the steel manufacturing, and a method of manufacturing the same.

Another embodiment of the present invention is to provide a non-oriented electrical steel sheet excellent in productivity as well as magnetic property and a method for manufacturing the same.

Technical Solution

A non-oriented electrical steel sheet according to an embodiment of the present invention comprises Si: 2.0 to 3.5%, Al: 0.3 to 3.5%, Mn: 0.2 to 4.5%, Zn: 0.0005 to 0.02% in wt % and Fe and inevitable impurities as a balance amount. A non-oriented electrical steel sheet according to an embodiment of the present invention may further comprise Y: 0.0005 to 0.01%. A non-oriented electrical steel sheet according to an embodiment of the present invention may satisfy the following Formula 1.

$$[Zn]/[Y]>1 \quad \text{[Formula 1]}$$

(Wherein [Zn] and [Y] represent the contents (wt %) of Zn and Y, respectively.)

A non-oriented electrical steel sheet according to an embodiment of the present invention may satisfy the following Formula 2.

$$[Zn]+[Y]\leq 0.025 \quad \text{[Formula 2]}$$

(Wherein [Zn] and [Y] represent the contents (wt %) of Zn and Y, respectively.)

The non-oriented electrical steel sheet may further comprise N: 0.0040% or less (excluding 0%), C: 0.0040% or less (excluding 0%), S: 0.0040% or less (excluding 0%), Ti: 0.0040% or less (excluding 0%), Nb: 0.0040% or less (excluding 0%), and V: 0.0040% or less (excluding 0%). the non-oriented electrical steel sheet comprises an inclusion, and the inclusion having a diameter of 0.5 to 1.0 μm may be 40 vol % or more of the total inclusion.

An inclusion having a diameter of 2 μm or less may be 80 vol % or more of the total inclusion.

The non-oriented electrical steel sheet comprises an inclusion, and the area of the total inclusion may be 0.2% or less with respect to the area of the total non-oriented electrical steel sheet. An average crystal grain particle diameter of non-oriented electrical steel sheet according to an embodiment of the present invention may be 50 to 95 μm.

A method for manufacturing a non-oriented electrical steel sheet according to an embodiment of the present invention comprises: heating a slab comprising Si: 2.0 to 3.5%, Al: 0.3 to 3.5%, Mn: 0.2 to 4.5%, Zn: 0.0005 to 0.02% in wt % and Fe and inevitable impurities as a balance amount; performing hot rolling on the slab to manufacture a hot rolled sheet; performing cold rolling on the hot rolled sheet to manufacture a cold rolled sheet; and performing final annealing on the cold rolled sheet. The slab may further comprise Y: 0.0005 to 0.01%. The slab may satisfy the following Formula 1.

$$[Zn]/[Y]>1 \quad \text{[Formula 1]}$$

(Wherein [Zn] and [Y] represent the contents (wt %) of Zn and Y, respectively)

The slab may satisfy the following Formula 2.

$$[Zn]+[Y]\leq 0.025 \quad \text{[Formula 2]}$$

(Wherein [Zn] and [Y] represent the contents (wt %) of Zn and Y, respectively.)

The slab may further comprise N: 0.0040% or less (excluding 0%), C: 0.0040% or less (excluding 0%), S: 0.0040% or less (excluding 0%), Ti: 0.0040% or less (excluding 0%), Nb: 0.0040% or less (excluding 0%), and V: 0.0040% or less (excluding 0%). The step of performing hot rolled sheet annealing on the hot rolled sheet may further comprise after the step of manufacturing a hot rolled sheet.

An annealing temperature in the step of performing final annealing on the cold rolled sheet may be 850 to 1050° C.

The steel sheet may be cooled at a cooling rate of 25 to 50° C./sec to 600° C., after the step of performing final annealing on the cold rolled sheet.

It may further comprise manufacturing molten steel; adding Si ferro alloy, Al ferro alloy and Mn ferro alloy to molten steel; adding Zn to molten steel and bubbling using an inert gas; and performing continuous casting to manufacture a slab before the step of heating slab.

Effects of the Invention

The non-oriented electrical steel sheet according to an embodiment of the present invention improves the purity of the molten steel by comprising Zn in a specific range, so that inclusions and precipitates are coarsened.

As s a result, the high-frequency iron loss and the low magnetic properties are improved, so that a non-oriented electrical steel sheet suitable for high-speed rotation may be manufactured.

Through this, motors of eco-friendly automobiles, high efficiency motors for home appliances and super premium class electric motors may be manufactured.

DETAILED DESCRIPTION OF THE INVENTION

The first term, second and third term, etc. are used to describe various parts, components, regions, layers and/or sections, but are not limited thereto.

These terms are only used to distinguish any part, component, region, layer or section from other part, component, region, layer or section.

Therefore, the first part, component, region, layer or section may be referred to as the second part, component, region, layer or section within the scope unless excluded from the scope of the present invention.

The terminology used herein is only to refer specific embodiments and is not intended to be limiting of the invention. The singular forms used herein comprise plural forms as well unless the phrases clearly indicate the opposite meaning.

The meaning of the term "comprise" is to specify a particular feature, region, integer, step, operation, element and/or component, not to exclude presence or addition of other features, regions, integers, steps, operations, elements and/or components. It will be understood that when an element such as a layer, coating, region, or substrate is referred to as being "on" another element, it can be directly on the other element or intervening elements may also be present.

In contrast, when an element is referred to as being "directly on" another element, there are no intervening elements present. Although not defined differently, every term comprising technical and scientific terms used herein have the same meaning as commonly understood by those who is having ordinary knowledge of the technical field to which the present invention belongs.

The commonly used predefined terms are further interpreted as having meanings consistent with the relevant technology literature and the present content and are not interpreted as ideal or very formal meanings unless otherwise defined. In addition, unless otherwise stated, % means wt %, and 1 ppm is 0.0001 wt %

In an embodiment of the present invention, the meaning further comprising additional elements means that the remainder (Fe) is replaced by additional amounts of the additional elements. Hereinafter, embodiments of the present invention will be described in detail so that those skilled in the art may easily carry out the present invention.

The present invention may, however, be implemented in several different forms and is not limited to the embodiments described herein.

In an embodiment of the present invention, not only optimizing the composition in the non-oriented electrical steel sheet especially the range of Si, Al and Mn which are the main additive components but also remarkably improving the structure and magnetic property by limiting the addition amount of the Zn which is a trace element. A non-oriented electrical steel sheet according to an embodiment of the present invention comprises Si: 2.0 to 3.5%, Al: 0.3 to 3.5%, Mn: 0.2 to 4.5%, Zn: 0.0005 to 0.02% in wt % and Fe and inevitable impurities as a balance amount. First, the reason for limiting the components of the non-oriented electrical steel sheet will be described.

Si: 2.0 to 3.5 Wt %

Silicon (Si) serves to lower the iron loss by increasing the specific resistance of the material, and in case it is added too little, the effect of improving the high-frequency iron loss may be insufficient. On the other hand, in case it is excessively added, the hardness of the material increases, and the cold rolling property is extremely deteriorated, so that the productivity and punching property may become inferior. Therefore, Si may be added in the above-mentioned range.

Al: 0.3 to 3.5 Wt %

Aluminum (Al) serves to lower the iron loss by increasing the specific resistance of the material, and if it is added too little, it is not effective in reduction of the high-frequency iron loss, and nitride is formed finely, which may deteriorate the magnetic property. On the other hand, if it is excessively added, problems may occur in all processes such as steel manufacturing, continuous casting and the like, and the productivity may be greatly lowered. Therefore, Al may be added in the above-mentioned range.

Mn: 0.2 to 4.5 Wt %

Manganese (Mn) serves to improve the iron loss and to form the sulfide by increasing the specific resistance of the material, and if it is added too little, MnS may precipitate finely and deteriorate the magnetic property. On the other hand, if it is excessively added, magnetic flux density may be reduced by promoting the formation of [111] structure which is disadvantageous to the magnetic property. Therefore, Mn may be added in the above-mentioned range. In an embodiment of the present invention, the specific resistance may be 55 to 80 μΩ·cm.

Zn: 0.0005 to 0.02 Wt %

Zinc (Zn) serves to improve clarity in the molten steel by reacting with the impurity elements. If it is added too little, it may not serve to improve the clarity of molten steel by coarsening inclusion and the like. On the other hand, if it is excessively added, formation of fine precipitates is promoted. Therefore, Zn may be added in the above-mentioned range.

Y: 0.0005 to 0.02 Wt %

Yttrium (Y) is added additionally to play a role of an additive which assists inclusion coarsening of Zn. In case Y is additionally added, it suppresses inclusions redissolution occurred in the subsequent annealing process by assisting inclusion coarsening of Zn and serves to decrease fine precipitates. if it is excessively added, the iron loss may be deteriorated by promoting the formation of fine precipitates. Zn and Y may satisfy the following Formula 1.

$$[Zn]/[Y]>1 \quad \text{[Formula 1]}$$

(Wherein [Zn] and [Y] represent the contents (wt %) of Zn and Y, respectively.)

Since Y is an element which is assisting the role of Zn, if the addition amount of Y is larger than Zn, it may rather promote the fine precipitation by interfering the inclusion coarsening. Therefore, the ratio may be limited as shown in Formula 1. Zn and Y may satisfy the following Formula 2.

$$[Zn]+[Y]\leq 0.025 \quad \text{[Formula 2]}$$

(Wherein [Zn] and [Y] represent the contents (wt %) of Zn and Y, respectively.)

If Zn and Y is excessively added, the iron loss may be deteriorated by promoting the formation of fine precipitates. Therefore, the contents may be limited as shown in Formula 2.

N: 0.0040 Wt % or Less

Nitrogen (N) forms nitride or carbide by combining with Ti, Nb and V, and it is preferable to limit to 0.0040 wt % or less, more specifically to 0.0030 wt % or less since the growth property of the crystal grains is lowered as the size becomes finer.

C: 0.0040 Wt % or Less

Since Carbon (C) serves to interfere with the growth property of the crystal grains and magnetic movement by reacting with N, Ti, Nb, V and the like and forming fine carbides, and it is preferable to limit to 0.0040 wt % or less, more specifically to 0.0030 wt % or less since it causes magnetic aging.

S: 0.0040 Wt % or Less

Since Sulfur (S) serves to lower the growth property of the crystal grains and to suppress magnetic movement by reacting with Mn and forming sulfide such as Mns and the like, it is preferable to control to 0.0040 wt % or less. More specifically, it is preferable to control to 0.0030 wt % or less.

Ti: 0.0040 Wt % or Less

Titanium (Ti) serves to lower the growth property of the crystal grains and to suppress magnetic domain movement by forming carbide or nitride, it is preferable to control it to 0.0040 wt % or less, more specifically 0.0030 wt % or less.

Nb: 0.0040 Wt % or Less

Since Niobium (Nb) serves to lower the growth property of the crystal grains and to suppress magnetic domain movement by forming carbide or nitride, it is preferable to control to 0.0040 wt % or less, more specifically to 0.0030 wt % or less.

V: 0.0040 Wt % or Less

Since Vanadium (V) serves to lower the growth property of the crystal grains and to suppress magnetic domain movement by forming carbide or nitride, it is preferable to control to 0.0040 wt % or less, more specifically to 0.0030 wt % or less.

Other Impurities

In addition to the above-mentioned elements, inevitably entrained impurities such as Mo, Mg, Cu and the like may be comprised. Although these elements are trace amounts, they may cause deterioration of magnetic property through formation of inclusions in the steel and the like, it must be managed to Mo and Mg: 0.005 wt % or less respectively, Cu: 0.025 wt % or less. In an embodiment of the present invention, by adding a certain amount of Zn, the size of the inclusions is appropriately controlled, and the magnetic property of the non-oriented electrical steel sheet is ultimately improved. More specifically, the non-oriented electrical steel sheet according to an embodiment of the present invention may have an inclusion having a diameter of 0.5 to 1.0 μm of 40 vol % or more of the total inclusion.

In this case, the diameter of the inclusion means a diameter of the circle assuming a virtual circle having the same area as the inclusions. These inclusions improve magnetic domain movement and exhibit excellent magnetic property. More specifically, an inclusion having a diameter of 2 μm or less may be 80 vol % or more of the total inclusion.

The non-oriented electrical steel sheet comprises an inclusion, and the area of the total inclusion may be 0.2% or less with respect to the area of the total non-oriented electrical steel sheet. An average crystal grain particle diameter of non-oriented electrical steel sheet according to an embodiment of the present invention may be 50 to 100 μm.

The magnetic properties of the non-oriented electrical steel sheet are superior within the above-mentioned range. As we mentioned above, the non-oriented electrical steel sheet according to an embodiment of the present invention improves high-frequency iron loss and the low magnetic properties. Specifically, the magnetic flux density at 50 Hz 100 A/m is 0.8 T or more, and the high-frequency iron loss ratio (1000 Hz/10000 Hz×100) at 0.1 T may be 3.2% or less. This means that the high-frequency iron loss is excellent not only in the area of several hundred Hz but also in the area of several tens of kHz.

If it exceeds 3.2%, the iron loss difference at high-speed rotation and low-speed rotation is large, which causes the overall motor efficiency gets worse. A method for manufacturing a non-oriented electrical steel sheet according to an embodiment of the present invention comprises heating a slab comprising Si: 2.0 to 3.5%, Al: 0.3 to 3.5%, Mn: 0.2 to 4.5%, Zn: 0.0005 to 0.02% in wt % and Fe and inevitable impurities as a balance amount; performing hot rolling on the slab to manufacture a hot rolled sheet; performing cold rolling on the hot rolled sheet to manufacture a cold rolled sheet; and performing final annealing on the cold rolled sheet.

Hereinafter, each step will be described in detail.

First, the slab is heated. Since the reason why the addition ratio of each composition in the slab is limited is the same as the reason for limiting the composition of the non-oriented electrical steel sheet which is mentioned above, the repeated description is omitted. The composition of the slab is substantially the same as that of the non-oriented electrical steel sheet since it does not substantially change during the manufacturing process such as hot rolling, annealing hot rolled sheet, cold rolling and final annealing and the like which will be described later.

It may be manufactured by manufacturing molten steel; adding Si ferro alloy, Al ferro alloy and Mn ferro alloy to molten steel; adding Zn to molten steel and bubbling using an inert gas; and performing continuous casting.

Si ferro alloy, Al ferro alloy and Mn ferro alloy, Zn and the like may be adjusted to be added so as to correspond to the composition range of the above-mentioned slab.

In case of adding Y additionally, it may be added simultaneously with Zn. Zn and Y may react by adding Zn and Y simultaneously and performing bubbling. The slab is inserted into a heating furnace and heated at 1100 to 1250° C.

If heated at a temperature which is exceeding 1250° C., the precipitate is dissolved again and may be precipitated finely after hot rolling.

The heated slab is hot rolled to 2 to 2.3 mm and manufactured a hot rolled sheet. In the step of manufacturing the hot rolled sheet, the finishing temperature may be 800 to 1000° C. After the step of manufacturing the hot rolled sheet, the step of annealing the hot rolled sheet may be further comprised.

In this case, annealing temperature of the hot rolled sheet may be 850 to 1150° C. If the annealing temperature of the hot rolled sheet is less than 850° C., the structure does not grow or grows finely that the synergistic effect of the magnetic flux density is small if the annealing temperature exceeds 1150° C., the magnetic property is rather deteriorated, and the hot workability may get worse due to the deformation of the sheet shape. More specifically, the temperature range may be 950 to 1125° C. More specifically, the annealing temperature of the hot rolled sheet may be 950 to 1125° C.

The hot rolled sheet annealing is performed to increase the orientation favorable to magnetic property as necessary and may be omitted. Next, the hot rolled sheet is pickled and cold rolled to be a predetermined sheet thickness. However, it may be applied depending on the thickness of the hot rolled sheet, it may be cold rolled to a final thickness of 0.2 to 0.65 mm by applying a percentage reduction in thickness of 70 to 95%.

The cold rolled sheet which is final cold rolled is subjected to final annealing so as to have an average particle diameter of a crystal grain of 50 to 95 μm. The final annealing temperature may be 850 to 1050° C. If the final annealing temperature is too low, recrystallization does not occur sufficiently, and if the final annealing temperature is too high, the rapid growth of crystal grains occurs, and magnetic flux density and high-frequency iron loss may become inferior. More specifically, it may be subjected to final annealing at a temperature of 900 to 1000° C. In the final annealing process, all the processed structure formed in the cold rolling step which is the previous step may be recrystallized (i.e., 99% or more).

After the final annealing, it may be cooled at a temperature of 600° C. at a cooling rate of 25 to 50° C./sec. By cooling at an appropriate cooling rate, coarsening of inclusions may be promoted. the non-oriented electrical steel sheet thus manufactured may have an inclusion having a diameter of 0.5 to 1.0 μm of 40 vol % or more of the total inclusion. An inclusion having a diameter of 2 μm or less may be 80 vol % or more of the total inclusion. The total area of the inclusion may be 0.2% or less with respect to the total area of non-oriented electrical steel sheet.

Hereinafter, the present invention will be described in more detail with reference to examples. However, these examples are only for illustrating the present invention, and the present invention is not limited thereto.

EXAMPLE 1

Slabs were manufactured as shown in the following Table 1. All of the elements other than those shown in Table 1 such as C, S, N, Ti and the like were controlled to 0.003 wt %.

The slab was heated at 1150° C., and finishing hot rolled at 850° C. to produce the hot rolled sheet having thickness of 2.0 mm.

The hot rolled sheet which has been hot rolled was annealed at 1100° C. for 4 minutes and then pickled.

Thereafter, it was cold rolled to a thickness of 0.25 mm, and final annealing was performed at the temperature listed in the following Table 2 for 45 seconds.

Thereafter, it was cooled to 600° C. at the cooling rate listed in the following Table 2, and finally the non-oriented electrical steel sheet was manufactured.

The magnetic properties were determined by the average value of rolling direction and vertical direction using the Single Sheet tester and are shown in the following Table 2.

The inclusions were observed with an optical microscope, the magnification was 500 times, the observation area was the cross section (TD) of the rolling vertical direction, and the area was observed at least 4 $mm^2$ or more. The diameter of the inclusion was expressed by the diameter assuming circle having the same area. The area ratios of inclusion having diameter of 0.5 to 1.0 μm with respect to the total area of the inclusion are summarized in the following Table 2.

TABLE 1

| Steel component (wt %) | Si | Al | Mn | Zn | Y | [Zn] + [Y] | [Zn]/[Y] | Specific resistivitance (μΩ · cm) | Note |
|---|---|---|---|---|---|---|---|---|---|
| 1 | 2 | 1 | 4 | 0.005 | 0.001 | 0.006 | 5 | 70 | Example |
| 2 | 2 | 2 | 2 | 0.004 | 0.005 | 0.009 | 0.8 | 70 | Comparative Example |
| 3 | 2 | 3 | 1.5 | 0.01 | 0.001 | 0.011 | 10 | 78 | Example |
| 4 | 2 | 1 | 4 | 0.02 | 0.01 | 0.03 | 2 | 70 | Comparative Example |
| 5 | 2 | 3 | 1.5 | 0.01 | 0.003 | 0.013 | 3.3 | 78 | Comparative Example |
| 6 | 2.5 | 0.7 | 2.5 | 0.005 | 0.003 | 0.008 | 1.7 | 64 | Example |
| 7 | 2.5 | 0.7 | 2 | 0.005 | 0.003 | 0.008 | 1.7 | 61 | Example |
| 8 | 2.5 | 3 | 1.4 | 0.005 | 0.0003 | 0.0053 | 16.7 | 83 | Comparative Example |
| 9 | 2.5 | 1 | 1 | 0.02 | 0.003 | 0.023 | 6.7 | 58 | Example |
| 10 | 2.5 | 1 | 1.8 | 0.0003 | 0.0003 | 0.0006 | 1 | 63 | Comparative Example |
| 11 | 3 | 1 | 1 | 0.005 | 0.003 | 0.008 | 1.7 | 64 | Comparative Example |
| 12 | 3 | 0.7 | 1.4 | 0.005 | 0.003 | 0.008 | 1.7 | 63 | Example |

TABLE 1-continued

| Steel component (wt %) | Si | Al | Mn | Zn | Y | [Zn] + [Y] | [Zn]/[Y] | Specific resistivitance (μΩ · cm) | Note |
|---|---|---|---|---|---|---|---|---|---|
| 13 | 3 | 0.7 | 2 | 0.025 | 0.003 | 0.028 | 8.3 | 66 | Comparative Example |
| 14 | 3 | 1 | 2 | 0.01 | 0.007 | 0.017 | 1.4 | 70 | Example |

TABLE 2

| Steel component | Final annealing temperature (° C.) | cooing rate (° C./sec) | Diameter Of Crystal grain (μm) | inclusion ratio (%) | B1 (T) | $W_{1/1000}$ (W/kg) | $W_{1/10000}$ (W/kg) | $W_{1/1000}/W_{1/10000} \times 100$ | Note |
|---|---|---|---|---|---|---|---|---|---|
| 1 | 1000 | 35 | 60 | 55 | 0.95 | 0.64 | 30.2 | 2.12 | Example |
| 2 | 970 | 40 | 48 | 38 | 0.78 | 1.07 | 32.8 | 3.26 | Comparative Example |
| 3 | 1000 | 30 | 58 | 45 | 0.85 | 0.51 | 25.8 | 1.98 | Example |
| 4 | 1000 | 30 | 45 | 37 | 0.78 | 0.94 | 33.2 | 2.83 | Comparative Example |
| 5 | 1000 | 20 | 48 | 35 | 0.84 | 0.94 | 28.5 | 3.3 | Comparative Example |
| 6 | 980 | 37 | 69 | 48 | 0.95 | 0.71 | 29.2 | 2.43 | Example |
| 7 | 950 | 38 | 75 | 58 | 0.91 | 0.68 | 28.5 | 2.39 | Example |
| 8 | 930 | 31 | 44 | 33 | 0.85 | 1.02 | 30.2 | 3.38 | Comparative Example |
| 9 | 1000 | 31 | 89 | 65 | 1.05 | 0.81 | 30.5 | 2.66 | Example |
| 10 | 1000 | 32 | 46 | 38 | 0.75 | 0.91 | 32.5 | 2.8 | Comparative Example |
| 11 | 800 | 32 | 35 | 32 | 0.93 | 1.08 | 32.5 | 3.32 | Comparative Example |
| 12 | 1000 | 30 | 93 | 50 | 1.11 | 0.79 | 32.1 | 2.46 | Example |
| 13 | 970 | 30 | 45 | 30 | 0.75 | 1.11 | 33.1 | 3.35 | Comparative Example |
| 14 | 970 | 34 | 78 | 56 | 1.07 | 0.81 | 32.5 | 2.49 | Example |

As shown in Table 1 and Table 2, in the case of the steel component of the embodiments, the excellence of the magnetic property may be confirmed by the increased ratio of the inclusions having a certain diameter.

On the other hand, in the case of the steel component of the comparative example in which the addition amount of Zn and Y is out of the range of the present invention, if the Zn and Y are not appropriately added or the temperature and cooling rate in the final annealing process are not appropriate, it may be confirmed that the inclusion properties are not satisfied and the magnetic property is poor.

The present invention is not limited to the above-mentioned examples or embodiments and may be manufactured in various forms, those who have ordinary knowledge of the technical field to which the present invention belongs may understand that it may be carried out in different and concrete forms without changing the technical idea or fundamental feature of the present invention. Therefore, the above-mentioned examples or embodiments are illustrative in all aspects and not limitative.

What is claimed is:

1. A non-oriented electrical steel sheet, comprising:

Si: 2.0 to 3.5%, Al: 0.3 to 3.5%, Mn: 0.2 to 4.5%, Zn: 0.0005 to 0.02% in wt %, Y: 0.0005 to 0.01% and Fe and inevitable impurities as a balance amount, wherein the non-oriented electrical steel sheet comprises an inclusion, and the inclusion having a diameter of 0.5 to 1.0 μm is 40 vol % or more of the total inclusion, and wherein the non-oriented electrical steel sheet satisfies the following Formula 1:

$$[Zn]/[Y]>1 \quad \text{Formula 1}$$

wherein [Zn] and [Y] represent the contents (wt %) of Zn and Y, respectively.

2. The non-oriented electrical steel sheet of claim 1, satisfying the following Formula 2

$$[Zn]+[Y]\leq 0.025 \quad \text{[Formula 2]}$$

wherein [Zn] and [Y] represent the contents (wt %) of Zn and Y, respectively.

3. The non-oriented electrical steel sheet of claim 1, further comprising N: 0.0040% or less (excluding 0%), C: 0.0040% or less (excluding 0%), S: 0.0040% or less (excluding 0%), Ti: 0.0040% or less (excluding 0%), Nb: 0.0040% or less (excluding 0%), and V: 0.0040% or less (excluding 0%).

4. The non-oriented electrical steel sheet of claim 1, wherein an inclusion having a diameter of 2 μm or less is 80 vol % or more of the total inclusion.

5. The non-oriented electrical steel sheet of claim 1, wherein the non-oriented electrical steel sheet comprises an inclusion, and the area of the total inclusion is 0.2% or less with respect to the area of the total non-oriented electrical steel sheet.

6. The non-oriented electrical steel sheet of claim 1, wherein an average particle diameter of a crystal grain is 50 to 95 μm.

7. A method for manufacturing a non-oriented electrical steel sheet comprising:

heating a slab comprising Si: 2.0 to 3.5%, Al: 0.3 to 3.5%, Mn: 0.2 to 4.5%, Zn: 0.0005 to 0.02%, Y: 0.0005 to 0.01% in wt % and Fe and inevitable impurities as a balance amount;

performing hot rolling on the slab to manufacture a hot rolled sheet;

performing cold rolling on the hot rolled sheet to manufacture a cold rolled sheet; and performing final annealing on the cold rolled sheet, wherein the non-oriented electrical steel sheet comprises an inclusion, and the inclusion having a diameter of 0.5 to 1.0 μm is 40 vol % or more of the total inclusion, and wherein the non-oriented electrical steel sheet satisfies the following Formula 1:

$$[Zn]/[Y]>1 \quad \text{[Formula 1]}$$

wherein [Zn] and [Y] represent the contents (wt %) of Zn and Y, respectively to thereby manufacture the non-oriented electrical steel sheet according to claim 1.

8. The method of claim 7, wherein the slab satisfies the following Formula 2

$$[Zn]+[Y]\leq 0.025 \quad \text{[Formula 2]}$$

wherein [Zn] and [Y] represent the contents (wt %) of Zn and Y, respectively.

9. The method of claim 7, wherein the slab further comprises N: 0.0040% or less (excluding 0%), C: 0.0040% or less (excluding 0%), S: 0.0040% or less (excluding 0%), Ti: 0.0040% or less (excluding 0%), Nb: 0.0040% or less (excluding 0%), and V: 0.0040% or less (excluding 0%).

10. The method of claim 7, further comprising performing hot rolled sheet annealing on the hot rolled sheet after the step of manufacturing a hot rolled sheet.

11. The method of claim 7, wherein an annealing temperature in the step of performing final annealing on the cold rolled sheet is 850 to 1050° C.

12. The method of claim 11, comprising cooling at a cooling rate of 25 to 50° C./sec to 600° C., after the step of performing final annealing on the cold rolled sheet.

13. The method of claim 7, further comprising manufacturing molten steel;

adding Si ferro alloy, Al ferro alloy and Mn ferro alloy to molten steel;

adding Zn to molten steel and bubbling using an inert gas; and performing continuous casting to manufacture a slab before the step of heating the slab.

* * * * *